US011268536B1

(12) United States Patent
Duong

(10) Patent No.: US 11,268,536 B1
(45) Date of Patent: Mar. 8, 2022

(54) IMPELLER EXDUCER CAVITY WITH FLOW RECIRCULATION

(71) Applicant: PRATT & WHITNEY CANADA CORP., Longueuil (CA)

(72) Inventor: Hien Duong, Mississauga (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 17/013,991

(22) Filed: Sep. 8, 2020

(51) Int. Cl.
*F04D 29/28* (2006.01)
*F04D 29/44* (2006.01)
*F04D 17/10* (2006.01)

(52) U.S. Cl.
CPC ..... *F04D 29/284* (2013.01); *F04D 17/10* (2013.01); *F04D 29/444* (2013.01)

(58) Field of Classification Search
None
See application file for complete search history.

(56) References Cited

U.S. PATENT DOCUMENTS

| | | | | |
|---|---|---|---|---|
| 3,804,547 | A | 4/1974 | Hagemann | |
| 4,131,389 | A | 12/1978 | Perrrone | |
| 4,445,816 | A | 5/1984 | Ribaud | |
| 5,516,263 | A | 5/1996 | Nishida | |
| 7,326,027 | B1 * | 2/2008 | Skoch | F04D 27/0207 415/150 |
| 7,648,331 | B2 | 1/2010 | Spakovszky | |
| 8,021,104 | B2 | 9/2011 | Gu et al. | |
| 8,087,249 | B2 | 1/2012 | Ottaviano et al. | |
| 8,147,178 | B2 | 4/2012 | Ottaviano et al. | |
| 8,287,233 | B2 | 10/2012 | Chen | |
| 9,234,526 | B2 | 1/2016 | Zheng et al. | |
| 9,644,639 | B2 | 5/2017 | Duong | |
| 9,726,084 | B2 | 8/2017 | Duong et al. | |
| 2008/0056892 | A1 * | 3/2008 | Barton | F04D 29/444 415/191 |
| 2010/0077768 | A1 * | 4/2010 | Leblanc | F04D 29/681 60/785 |

(Continued)

FOREIGN PATENT DOCUMENTS

| | | |
|---|---|---|
| EP | 1881181 | 1/2008 |
| EP | 2169237 | 3/2010 |

(Continued)

OTHER PUBLICATIONS

European Search report dated Jul. 30, 2020 for application No. 20163432.6.

*Primary Examiner* — Michael Lebentritt
(74) *Attorney, Agent, or Firm* — Norton Rose Fulbright Canada LLP

(57) ABSTRACT

A centrifugal compressor for an aircraft engine is disclosed, having an impeller mounted for rotation about an axis. The impeller has impeller blades extending from an inducer end to an exducer end. A shroud extends over the impeller blades. A main flow passage is defined between the shroud and the impeller, a cavity fluidly communicates with the main flow passage via at least one extraction port and at least one reinjection port. The reinjection port is fluidly connected to the main flow passage upstream of the extraction port relative to a flow direction through the main flow passage. The reinjection port is disposed upstream of the exducer end of the impeller blade, in an exducer portion of the shroud.

19 Claims, 9 Drawing Sheets

(56) References Cited

U.S. PATENT DOCUMENTS

| | | | | |
|---|---|---|---|---|
| 2012/0186605 | A1* | 7/2012 | Nakaniwa | F01D 25/002 134/24 |
| 2013/0051974 | A1 | 2/2013 | Poon | |
| 2014/0369823 | A1* | 12/2014 | Yamashita | F04D 29/284 415/203 |
| 2015/0226232 | A1* | 8/2015 | Duong | F04D 29/684 415/1 |
| 2015/0275917 | A1* | 10/2015 | Fukuyama | F04D 17/10 415/148 |
| 2016/0186601 | A1* | 6/2016 | Manning | F01D 25/005 415/121.2 |
| 2017/0198713 | A1 | 7/2017 | Bessho | |
| 2017/0211595 | A1* | 7/2017 | Bertoneri | F04D 29/4206 |
| 2017/0248155 | A1 | 8/2017 | Parker et al. | |
| 2017/0260998 | A1* | 9/2017 | Masutani | F04D 29/30 |
| 2017/0284401 | A1 | 10/2017 | Kreienkamp | |
| 2018/0080456 | A1* | 3/2018 | Masutani | F04D 29/284 |
| 2018/0100514 | A1* | 4/2018 | Venkataraman | F16J 15/4472 |
| 2018/0347589 | A1* | 12/2018 | Yanagisawa | F04D 29/5833 |
| 2019/0128270 | A1* | 5/2019 | Pelton | F04D 27/009 |
| 2019/0226488 | A1* | 7/2019 | Tawfik | F04D 29/542 |
| 2019/0285072 | A1* | 9/2019 | Masutani | F04D 17/12 |
| 2020/0049158 | A1 | 2/2020 | Brogelli | |
| 2020/0291959 | A1* | 9/2020 | Duong | F04D 29/685 |

FOREIGN PATENT DOCUMENTS

| | | |
|---|---|---|
| EP | 2905477 | 8/2015 |
| GB | 1132485 | 11/1968 |

* cited by examiner

IMPELLER EXDUCER CAVITY WITH FLOW RECIRCULATION

TECHNICAL FIELD

The application relates generally to gas turbine engines, and more particularly to centrifugal compressors.

BACKGROUND OF THE ART

Centrifugal compressors include an impeller surrounded by a shroud and a diffuser downstream therefrom. They achieve a pressure rise by adding kinetic energy to a flow of fluid through the impeller. The combination of the rapid rise in pressure and the relatively high curvature of the flow path from an axial to a radial direction in the centrifugal compressors may cause a relatively high adverse pressure gradient to develop as the fluid flow negotiates the curved shroud surface. This phenomenon may generally be observed with compressible fluids. This may result in a build-up of the boundary layer at the curved shroud surface due to the change between axial momentum to radial momentum of the fluid flow. Flow blockage may occur in the centrifugal compressors, especially at or aft the bend area of the impeller. Such flow blockage may reduce the pressure gains achieved by the centrifugal compressor. Large flow blockage may impose high incidence on the diffuser downstream of the impeller.

SUMMARY

In accordance with a first aspect, there is provided a centrifugal compressor for an aircraft engine, comprising: an impeller mounted for rotation about an axis, the impeller having impeller blades extending from an inducer end to an exducer end; a shroud extending over the impeller blades; a main flow passage defined between the shroud and the impeller; a cavity fluidly communicating with the main flow passage via at least one extraction port and at least one reinjection port, the reinjection port fluidly connected to the main flow passage upstream of the extraction port relative to a flow direction through the main flow passage, the reinjection port disposed upstream of the exducer end of the impeller blade, in an exducer portion of the shroud.

In accordance with a second aspect, there is provided a compressor section of an aircraft engine, comprising: a centrifugal compressor including: an impeller with impeller blades extending from an inducer end to an exducer end, a shroud extending about the impeller, the impeller mounted for rotation about an axis within the shroud, a main flow passage extending between the impeller and the shroud to an impeller exit defined downstream of the impeller, a cavity disposed adjacent the impeller exit, the cavity fluidly communicating with the main flow passage via at least one extraction port and at least one reinjection port, the reinjection port fluidly connected to the main flow passage closer from the central longitudinal axis than the extraction port, in an exducer portion of the shroud; and a diffuser body mounted about the impeller exit so as to receive a flow therefrom.

In accordance with a third aspect, there is provided a method of re-energizing a flow in an exducer portion of a compressor, the compressor including an impeller mounted for rotation about a central longitudinal axis, the method comprising: circulating part of the flow through a cavity having at least one extraction port fluidly connected to a main flow passage of the compressor downstream of at least one reinjection port fluidly connected to the main flow passage.

In further accordance with the third aspect, for example, circulating part of the flow includes extracting said part of the flow downstream of an exducer end of the impeller.

In further accordance with the third aspect, for example, circulating includes reinjecting at least a fraction of said part of the flow back to the main flow passage at a location radially inward relative to the extraction port, in the exducer portion.

In further accordance with the third aspect, for example, injecting at least said fraction of said part of the flow includes accelerating said fraction of said part of the flow through the injection port.

BRIEF DESCRIPTION OF THE DRAWINGS

Reference is now made to the accompanying figures in which:

FIG. 2C is a schematic cross-sectional partial view of the centrifugal compressor, taken in a plane normal to a central axis of the centrifugal compressor, showing another example of a shroud of the centrifugal compressor, according to an embodiment;

DETAILED DESCRIPTION

Figure 1:
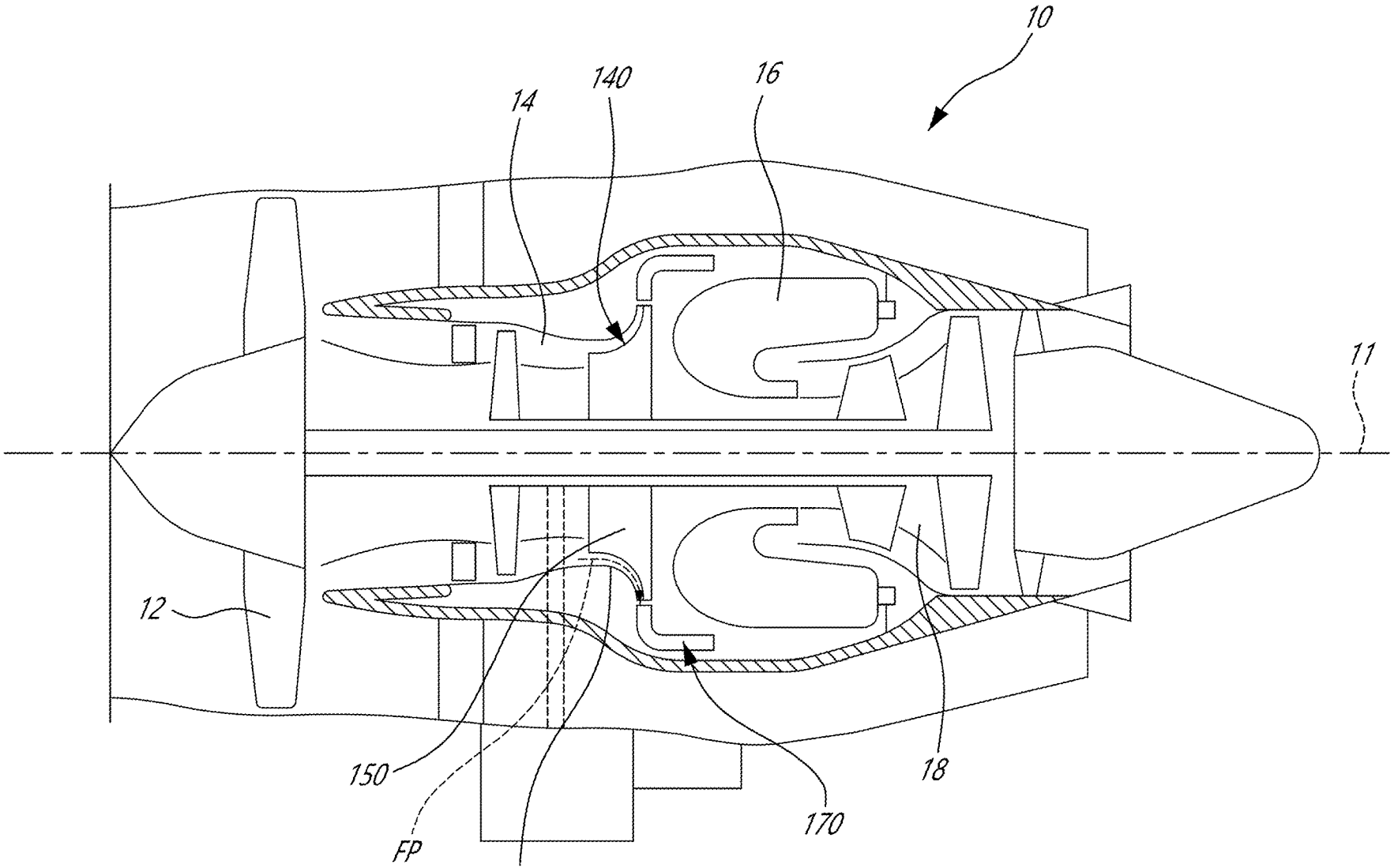
FIG. 1 is a schematic cross-sectional view of a gas turbine engine.

FIG. 1 illustrates an exemplary gas turbine engine 10 of a type preferably provided for use in subsonic flight. The exemplary gas turbine engine 10 as shown is a turbofan, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. Also shown is a central longitudinal axis 11 of the engine 10. Even though the following description and accompanying drawings specifically refer to a turbofan engine as an example, it is understood that aspects of the present disclosure may be equally applicable to other types of aircraft engines in general, and other types of gas turbine engines in particularly, including but not limited to turboshaft and turboprop engines, auxiliary power units (APU), and the like.

The compressor section 14 of the engine 10 includes one or more compressor stages disposed in flow series. For instance, the compressor section 14 may comprise a number of serially interconnected axial compressor stages feeding into a radial compressor stage having a centrifugal compressor 140. The centrifugal compressor 140 has a main flow passage FP defined therethrough and includes an impeller 150 having a disc 152 from which a plurality of circumferentially spaced-apart blades 151 extends. The impeller 150 is mounted for rotation within a shroud 160 about the central axis 11. The disc 152 of the impeller 150 may be mounted to a shaft not shown) in the compressor section 14, directly, or via a gearbox for instance.

Figure 2:
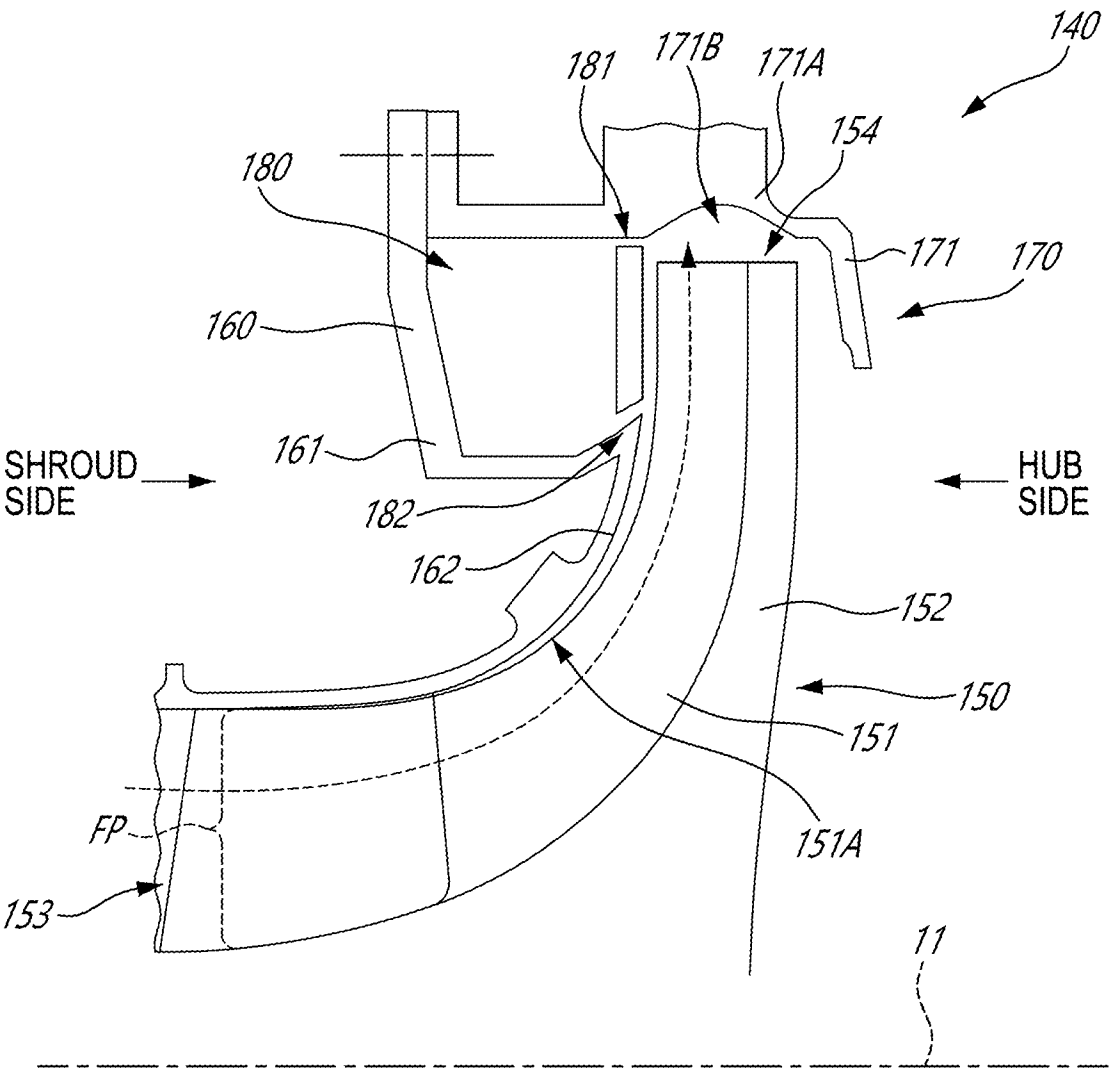
FIG. 2 is a schematic cross-sectional partial view of a centrifugal compressor with an impeller, as used in the gas turbine engine shown in FIG. 1, taken along a meridional plane of the centrifugal compressor.

As shown in FIG. 2, the impeller blades 151 extend from an axial inlet or inducer end 153 of the impeller 150 to a radial outlet or exducer end 154 at which the gas flow exits the impeller 150 substantially radially (90±10 degrees or between 75 and 90 degrees for instance) relative to the central longitudinal axis 11. The impeller blades 151 define an intermediate bend 151A from axial to radial between the inducer end 153 and the exducer end 154. The bend 151A generally defines a bend area of the impeller 150. The impeller blades 151 each have a pressure side and a suction side, named as such with reference to the pressure differential between the gas flow pressure to the fore of the blades 151 versus the aft of the blades 151 caused by rotation of the impeller 150 and fluid interaction with the main gas flow. As will be seen herein after, this may set up a circumferentially varying pattern of flow distortion at an exit of the impeller downstream of the impeller blades 151, in other words at the exducer end 154 or "tip" of the blades 151 of the impeller 150.

In accordance with at least some embodiments, the shroud 160 encloses the impeller 150, thereby forming a substantially closed system, whereby the compressible fluid enters axially the shroud 160, flows through the main flow passage FP, and exits substantially radially outwardly relative to the engine axis 11. The shroud 160 has a shroud body 161, which makes up the corpus of the shroud 160 and provides it with its structure and its ability to resist the loads generated by the compressor 140 when in operation. The shroud body 161 has a gas path surface 162, which is the face of the shroud 160 that is exposed to the fluid flow, and which defines a wall of the main flow passage FP of the shroud side of the impeller 150 as shown in FIG. 2.

Figure 2A:
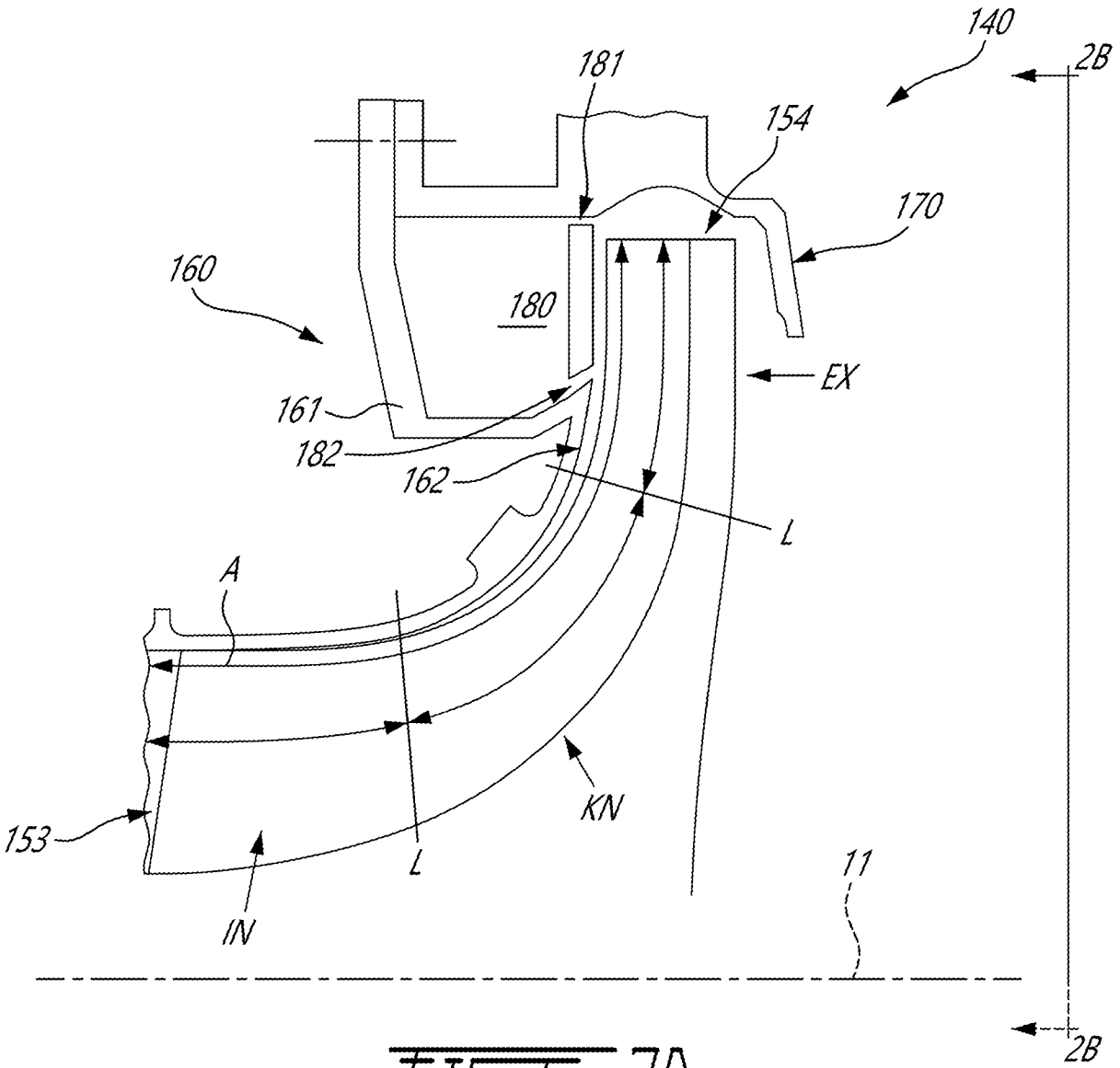
FIG. 2A is another schematic cross-sectional partial view of the centrifugal compressor of FIG. 2.

As shown in FIG. 2A, the gas path surface 162 of the shroud 160 has a curved profile, which may match the curvature of the impeller blades 151, and which extends between an inducer portion IN and an exducer portion EX of the gas path surface 162. The location and relative size of the inducer portion IN and the exducer portion EX on the gas path surface 162 of the shroud 160 may vary for different centrifugal compressors 140. The locations of the inducer portion IN and the exducer portion EX may be given relative to a bend portion KN, or "knee", of the gas path surface 162. Still referring to FIG. 2A, the bend portion KN can be defined by a bend length, which begins at a point where the substantially axial compressible fluid starts to curve or bend, and ends at a point where the compressible fluid first begins to flow in a substantially radial direction. The bend portion KN is demarcated in FIG. 2A by lines L, which extend in a direction normal to the gas path surface 162 at the location where the flow transitions from an axial direction, and where it transitions to a substantially radial direction. The inducer portion IN can be any part of the gas path surface 162 which is upstream of the bend portion KN, and the exducer portion EX can be any part of the gas path surface 162 which is downstream of the bend portion KN.

For the exemplary compressor 140 shown in FIGS. 2 and 2A, the inducer portion IN corresponds to the part of the gas path surface 162 of the shroud 160 in proximity to the inducer end 153 of the impeller 150. The inducer portion IN in the depicted embodiment is defined by a generally straight-line (or slightly curved) segment which is substantially parallel to the central axis 11, and corresponds to the portion of the shroud 160 that receives the fluid flow. In the depicted embodiment, the inducer portion IN extends from the impeller inlet 153 to about one third (0.33±0.05) of a chord A of the impeller 150 extending from the inducer end 153 to the exducer end 154. Inducer portions IN having other configurations (or impeller relative chord) are contemplated.

Still for the compressor 140 shown in FIGS. 2 and 2A, the exducer portion EX corresponds to the part of the gas path surface 162 of the shroud 160 in proximity to the exit or exducer end 154 of the impeller 150. The exducer portion EX in the depicted embodiment is a substantially straight-line (or slightly curved) segment extending from the end of the bend portion KN of the gas path surface 162. The exducer portion EX extends generally radially with respect to the central axis 11 at the exducer end 154. In the depicted embodiment, the exducer portion EX extends from the exducer end 154 of the impeller 150 to about one third (0.33±0.05) of the chord A of the impeller 150. Exducer portions EX having other configurations (or impeller relative chord) are contemplated.

A diffuser 170 is disposed immediately downstream of the impeller 150 for converting kinetic energy to an increased potential energy/static pressure by slowing down the airflow through the diffuser 170. Referring jointly to FIGS. 1 and 2, it can be seen that the diffuser 170 forms a fluid connection between the impeller 150 and the combustor 16 (see FIG. 1), thereby allowing the impeller 150 to be in serial flow communication with the combustor 16. The exemplified diffuser 170 is configured to redirect the radial flow of the main gas flow exiting the impeller 150 to an annular axial flow for presentation to the combustor 16. In some embodiments of the gas turbine engine 10, the diffuser 170 may include vanes (not shown) downstream of the impeller 150 by which the radial flow leaving the impeller 150 may exit the diffuser 170 and be led toward the next compressor stage or to the combustor 16. In other embodiments of the gas turbine engine 10, the diffuser 170 may include one or more fishtail diffuser pipes directing the flow downstream of the impeller 150 to exit the diffuser 170. The diffuser 170, with or without vanes, is configured to reduce the velocity and increase the static pressure of the main gas flow as it flows therethrough. The exemplified diffuser 170 includes an annular diffuser body 171 mounted about the impeller 150. The diffuser body 171 forms the corpus of the diffuser 170 and provides the structural support required to resist the loads generated during operation of the centrifugal compressor 140. The diffuser body 171 is mounted about a circumference of the compressor or impeller exit so as to receive the main gas flow therefrom. In some embodiments, such as the depicted one, the diffuser body 171 forms an annular diffuser ring 171A extending circumferentially about the impeller exducer end 154. In the depicted embodiment, the annular diffuser ring 171A defines a vaneless space 171B downstream of the impeller 150. As shown, the vaneless space 171B defines a wall facing radially inwardly towards the exducer end 154 of the impeller 150. The flow exiting the impeller 150 is directed to the vaneless space 171B radially outwardly before being redirected in other directions via other parts of the annular diffuser ring, for instance towards the combustor 16.

Flow blockage is a phenomenon observed in many centrifugal compressors, in particular with compressible fluids. The flow of a compressible fluid at the exit of the impeller 150 may be highly turbulent. The pressure of such compressible fluid may be raised rapidly after the impeller inducer end 153, starting at the intermediate bend 151A. The combination of the rapid rise in pressure and the relatively high curvature of the shroud gas path surface 162 may cause a relatively high adverse pressure gradient to develop as the compressible fluid negotiates the curved shroud gas path surface 162 from axial to radial. This may result in a build-up of the boundary layer at the curved shroud gas path surface 162 due to the change between axial momentum to radial momentum of the compressible fluid. Part of the flow may "stagnate" in the boundary layer or have a lower velocity than away from shroud gas path surface 162 (positive gradient projecting out from the curved gas path surface 162), with such boundary layer tending to reduce the velocity of the flow in the vicinity therewith. In other words, aft of the bend area of the impeller 150, the boundary layer bordering the curved shroud gas path surface 162 may thicken and may be characterized as a low momentum flow layer, which may lead to increased flow blockage. Such flow blockage may reduce the pressure gains achieved by the centrifugal compressor 140 and/or weaken/deteriorate the main flow exiting the bend area of the impeller 150, which may thus fail to negotiate the curved shroud gas path surface 162 and cause even more flow blockage as the flow follows its path to the impeller exit. Flow blockage may impose high incidence on the diffuser 170 downstream of the impeller 150.

Referring to FIG. 2, the centrifugal compressor 140 includes a cavity 180 fluidly communicating with the main flow passage FP via at least one extraction port 181 and at least one reinjection port 182 extending between the cavity 180 and the main flow passage FP. The reinjection port 182 is fluidly connected to the main flow passage FP upstream of the extraction port 181 relative to a flow direction (see direction of dashed line arrow in FIG. 2) through the main flow passage FP of the impeller 150. As will be further described below in connection with other features of the centrifugal compressor 140 referred to herein, re-energizing the fluid flow upstream of the impeller exit (i.e. the exducer end 154 of the impeller 150) by recirculating part of the fluid flow extracted close to the impeller exit in the exducer portion EX of the shroud 160 may improve the conditions of the flow exiting the impeller 150, whereby the function of the diffuser 170 downstream therefrom may be facilitated. Recirculation may allow low momentum flow at the exducer end 154 of the impeller 150 to be reduced/removed and returned upstream, near the bend area of the impeller 150, with higher momentum. The introduction of higher momentum near the bend area of the impeller 150 may allow re-energizing the boundary layer, which may become more tolerant to flow separation. Such improved conditions of the flow exiting the impeller 150 may favorably affect the performance of the diffuser 170 downstream thereof. In some cases, improving impeller exit conditions may lead to improve diffuser performance especially at high speeds where diffuser controls may be more likely to stall.

According to the embodiment illustrated in FIG. 2, the cavity 180 is disposed on the shroud side of the impeller 150, on one side of a main flow passage wall separating the main flow passage FP from the cavity 180, where the main flow passage wall is located adjacent the exducer end 154 of the impeller 150. In the depicted embodiment, where the diffuser body 171 forms an annular ring 171A, the cavity 180 may be circumscribed by the annular ring 171A and an adjacent portion of the shroud 160. As shown, the diffuser body 171 defines a radially outward peripheral wall of the cavity 180, and the shroud 160 defines a radially inward peripheral wall of the cavity 180. In other embodiments, the cavity 180 may be an internal cavity defined solely in the diffuser body 171 or solely in the shroud 160. The cavity 180 may be located on the hub side in other embodiments, though there may be structural restriction (limited available space) rendering such placement less desirable depending on the engines.

Figure 2B:
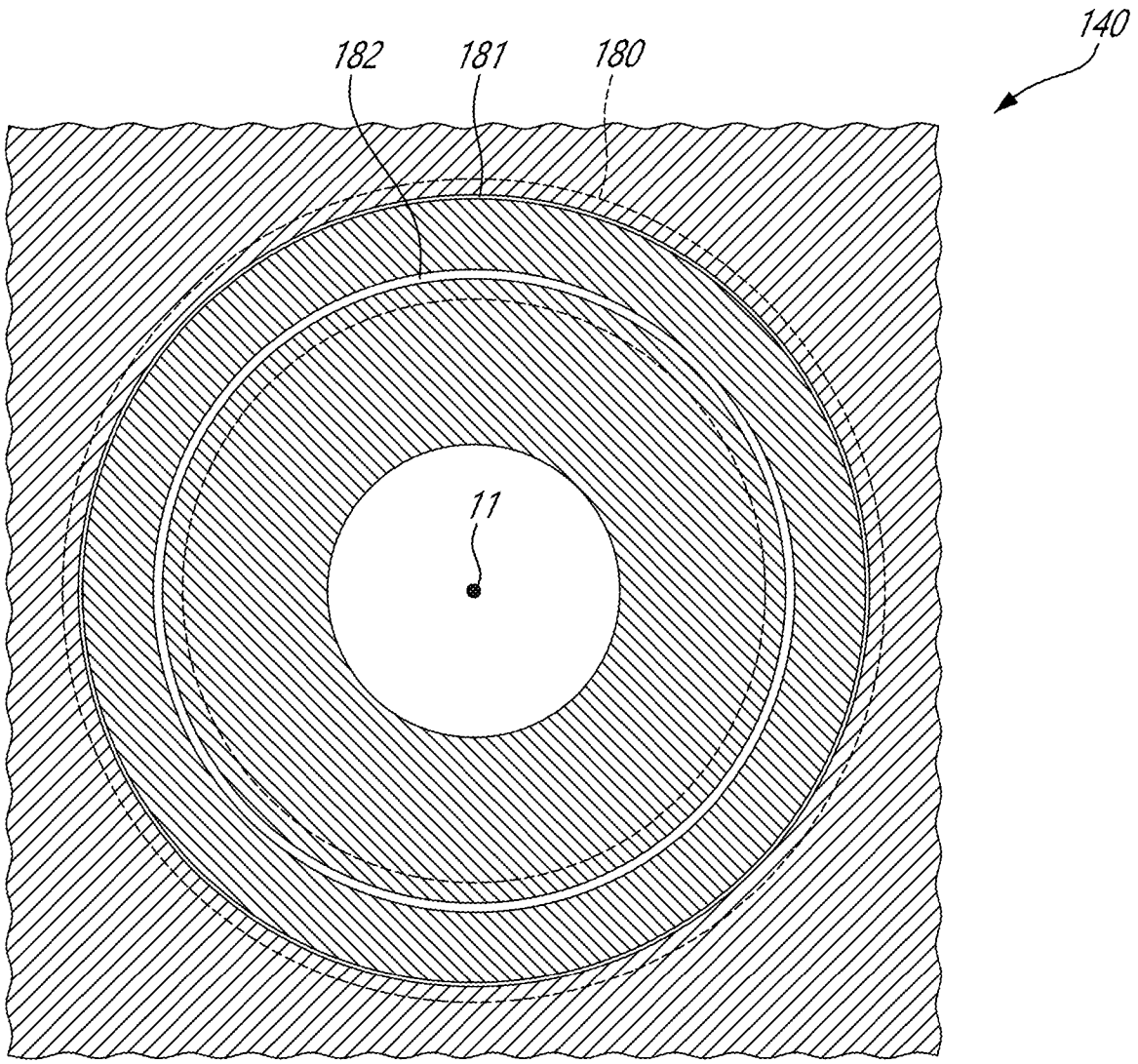
FIG. 2B is a schematic cross-sectional partial view of the centrifugal compressor of FIG. 2, taken in a plane 2B of FIG. 2A, normal to a central axis of the centrifugal compressor showing a shroud of the centrifugal compressor.
Figure 5C:
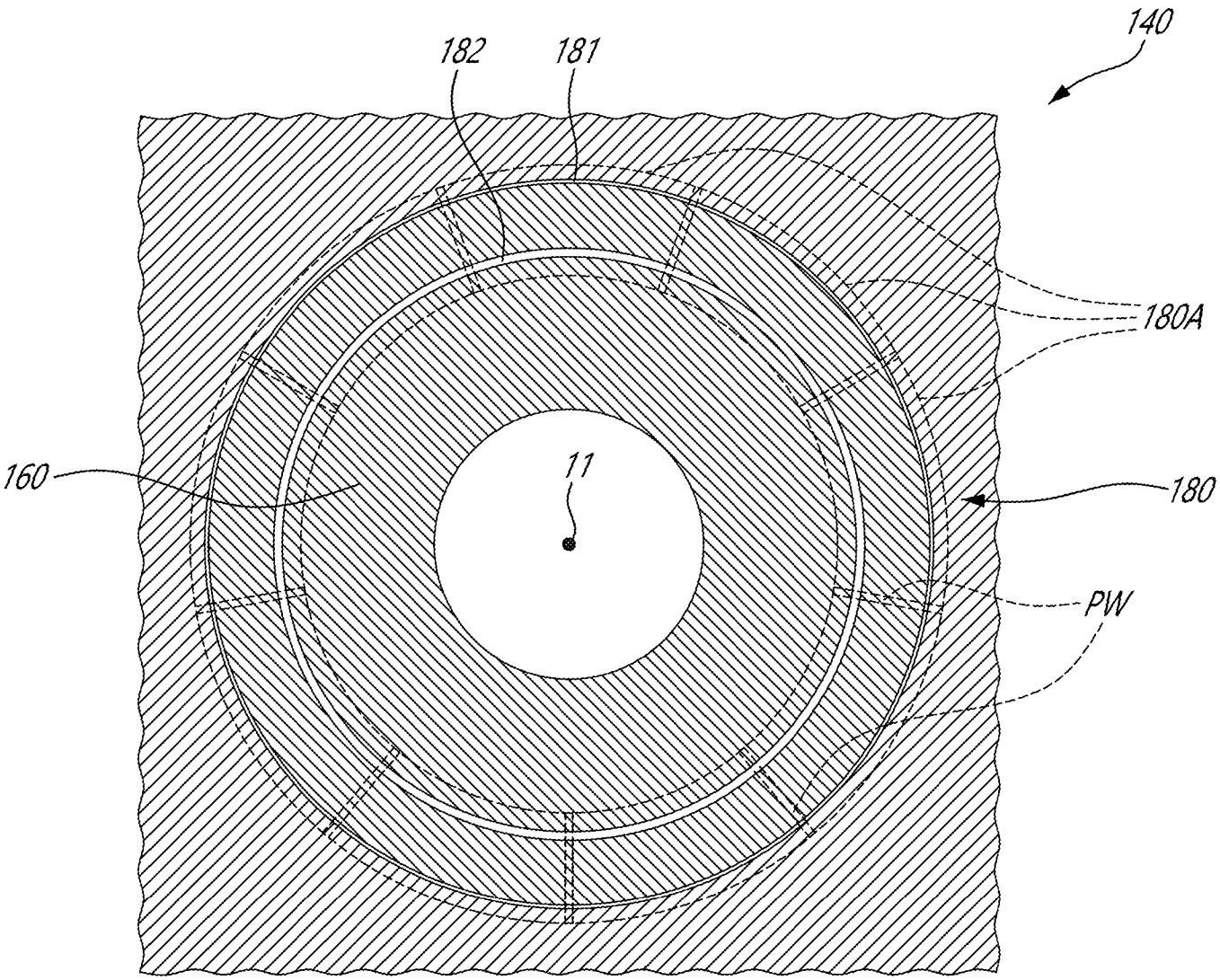
FIG. 5 is a schematic cross-sectional partial view of another exemplary shroud of the centrifugal compressor taken in plane normal to a central axis of the centrifugal compressor, according to an embodiment.

In the depicted embodiment, the cavity 180 is an annular chamber extending circumferentially about the axis 11 (see FIG. 2B). As shown, the cavity 180 defines a chamber or internal volume with a volumetric footprint larger than that of the ports 181, 182.

In other embodiments, such as shown in FIG. 2C, the cavity 180 may be discontinuous, such that the cavity 180 may define a series of spaced apart (or segmented, fully or partially) sub-chambers distributed about the impeller 150 (impeller not shown on FIG. 2C), though having the cavity 180 in the form of an annular chamber extending over 360 degrees about the impeller 150 may allow flow communication between the main flow passage FP and the cavity 180, via the ports 181, 182 with more freedom than in embodiments with spaced apart sub-chambers. In some embodiments, such as shown in FIG. 2C, it may be desirable, on a structural standpoint for instance, to have partition walls PW segmenting the cavity into a series of spaced apart sub-chambers 180A within the shroud 160, about the impeller 150. Depending on the embodiments, such partition walls PW may partially or fully partition the cavity 180, such that sub-chambers 180A may or may not be fluidly connected to each other otherwise than via flow communication with the main flow passage FP. Such partition walls PW may contribute to the structural integrity of the shroud 160.

In at least some embodiments, the cavity 180 is configured to decelerate the flow entering the cavity 180. The flow entering the cavity 180 may slow down because of the size/volume of the cavity 180. In at least some embodiments, the cavity 180 may be sized and/or shaped to maximize the flow deceleration, within the limited available space in the engine 10. For instance, in a particular embodiment, the size of the cavity is maximized within the limited dedicated space within the engine 10. Slowing down the flow may reduce skin friction loss as the flow is redirected to be reinjected through the reinjection port 182. Reducing a velocity of the flow via the cavity 180 before it gets reinjected in the main flow passage FP via the reinjection port 182 may facilitate redirecting the flow to turn more easily, in particular with high pressure ratio systems, such as aircraft engines.

Returning to FIG. 2A, the cavity 180 is located radially outward relative to the inducer portion IN and the bend portion KN, on the shroud side of the impeller 150. The cavity 180 is at least in part radially aligned with the bend portion KN (in some cases, the entire footprint of the cavity 180 is axially aligned about the bend portion KN). As shown, at least part of the cavity 180 extends radially along the exducer portion EX. The cavity 180 may be located somewhere else in other embodiments, though fluid flow communication at the impeller exit with the main flow passage FP could require more plumbing/conduits to channel the flow at the impeller exit.

Figure 3:
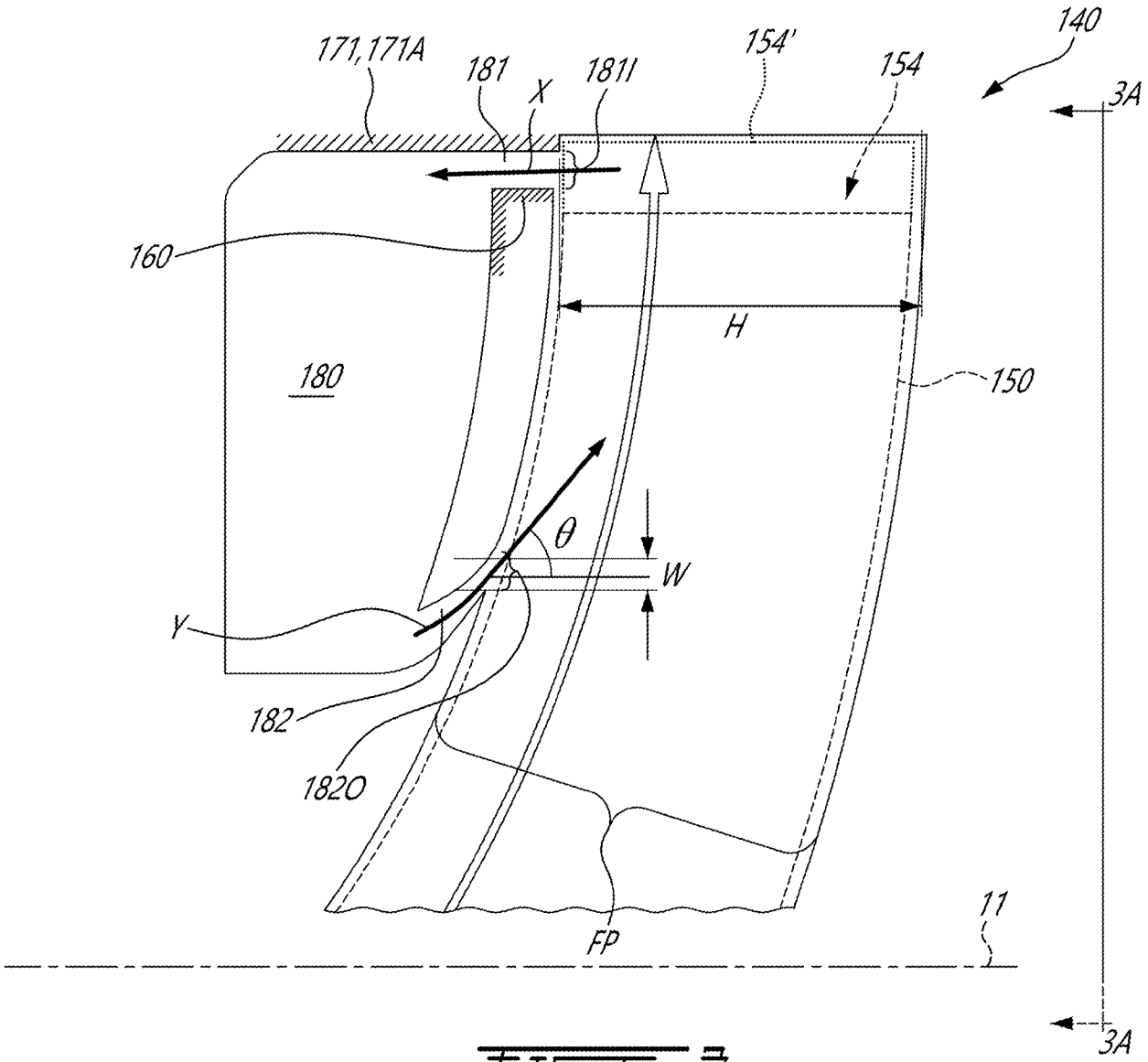
FIG. 3 is a magnified view of a schematic cross-sectional partial view of the centrifugal compressor of FIGS. 2 and 2A, showing an exducer portion in the centrifugal compressor, with the impeller shown in dashed line, according to an embodiment.

As mentioned above, the cavity 180 is in fluid communication with the main flow passage FP at the impeller exit via at least one extraction port 181. Referring to FIG. 3, in the embodiment of the impeller 150 depicted in dashed lines, the extraction port 181 is located downstream of the impeller 150, adjacent the exducer end 154 of the impeller 150. In other embodiments, the extraction port 181 may be slightly upstream of the exducer end 154 such that a projection of a central line X of the extraction port 181 may intersect with the impeller (see this scenario in FIG. 3, where impeller outlet 154 may be at the dotted lines (identified as 154') instead of dashed lines, in an alternate configuration of the centrifugal compressor), or the projection of the central line X may be generally at a same distance from the central axis 11 as the exducer end 154, among other possibilities.

Figure 3A:
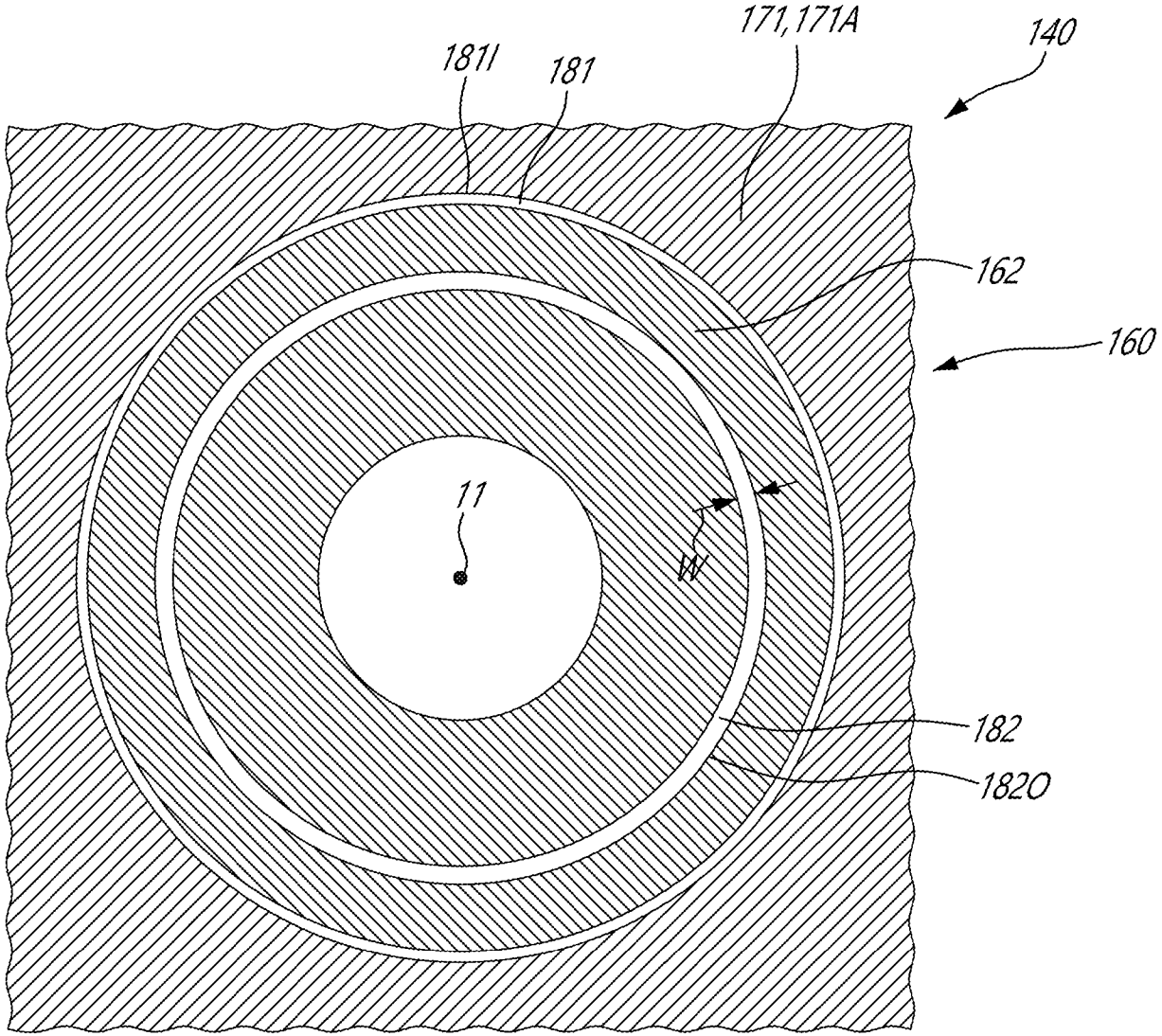
FIG. 3A is a schematic cross-sectional partial view of the centrifugal compressor, taken in a plane 3A of FIG. 3, normal to a central axis of the centrifugal compressor.

In accordance with at least some embodiments, the extraction port 181 is defined by a gap extending radially between the diffuser body 171, or diffuser ring 171B if present, and the shroud 160. The gap may be an annular gap that extends circumferentially about the central axis 11 of the impeller 150, as shown in FIG. 3A). In accordance with such an embodiment, there is a single extraction port 181 extending between the cavity 180 and the main flow passage FP, with such extraction port 181 extending annularly about the impeller 150. The presence of such gap may also allow thermal expansion of the shroud 160 and/or diffuser 170, without interference of the diffuser ring 171B with the shroud 160 at such location. In other embodiments (not shown), the extraction port 181 may be defined through a portion of the shroud 160. In such case, the main flow passage wall through which the extraction port 181 is defined is part of the shroud 160. Having the extraction port 181 defined through the shroud 160 instead of at a gap between the shroud 160 and the diffuser 170 may increase vibration and/or weaken the shroud 160, though this could be contemplated. In other embodiments, the extraction port 181 may be defined through a portion of the diffuser body 171. In such case, the main flow passage wall through which the extraction port 181 is defined is part of the diffuser body 171. This may depend on the location of the cavity 180 (within the shroud 160 or within the diffuser body 171).

In the depicted embodiment, the extraction port 181 in the form of the annular gap between the shroud 160 and the diffuser body 171 extends axially, parallel to the central axis 11. The extraction port 181 may extend angularly, radially inwardly or outwardly, from the inlet 1811 in other embodiments. In the depicted embodiment, the extraction port 181 has a constant cross-section from the inlet 1811 to the cavity 180, though the cross-section may vary in size and/or shape (e.g. convergent, divergent or both) in other embodiments.

Figure 3B:
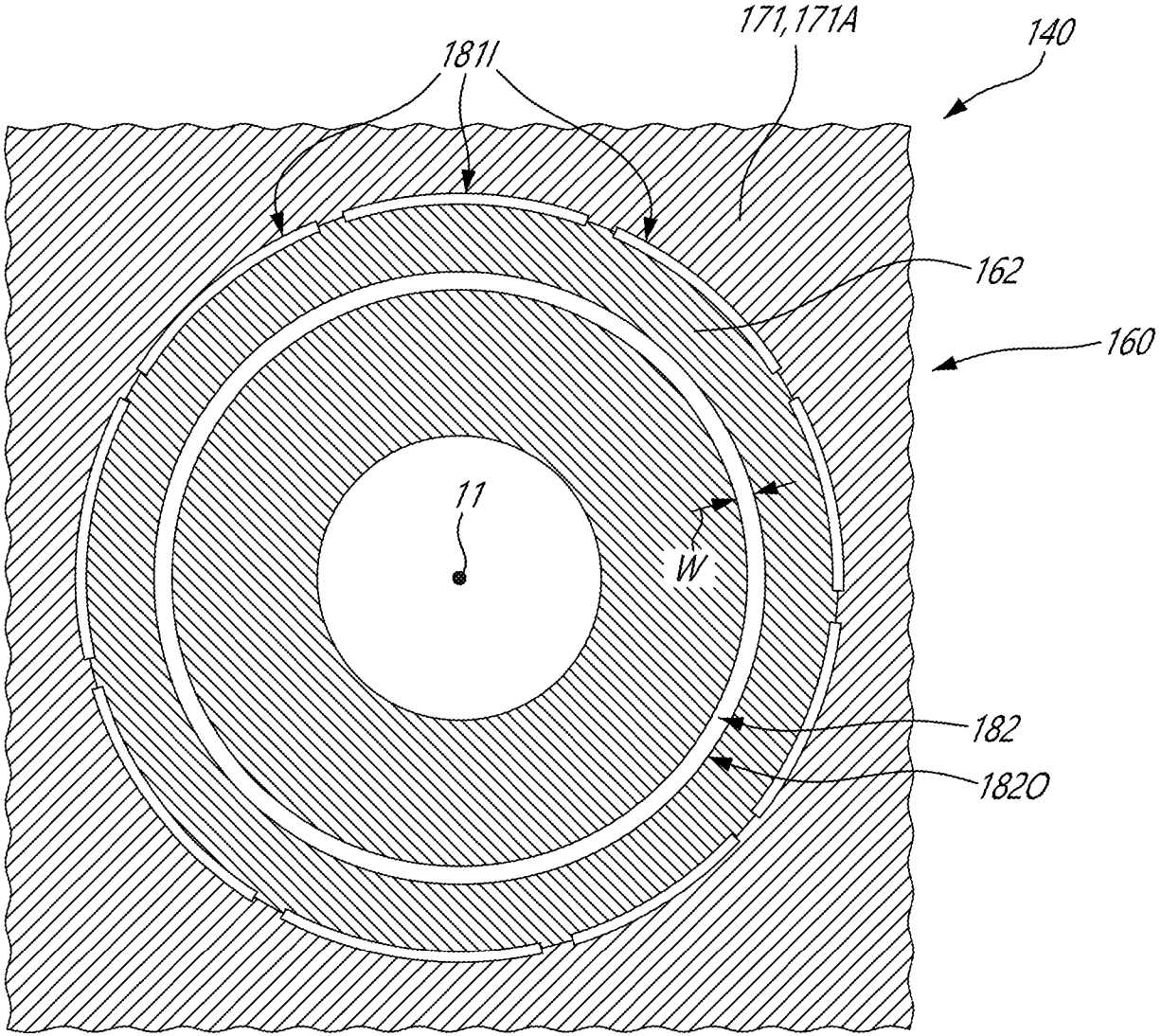
FIG. 3B is a schematic cross-sectional partial view of the centrifugal compressor, taken in a plane normal to a central axis of the centrifugal compressor, according to an embodiment.

In other embodiments, the gap may be discontinuous, i.e. not extending continuously over the entire circumference of the impeller 150. For instance, in some embodiments where the gap is discontinuous, such as shown in the example of FIG. 3B, the gap may define a series of spaced apart inlets 1811 defined through the main flow passage wall and that extend between the cavity 180 and the main flow passage FP. For instance, the inlets 1811 may be circumferentially equally spaced apart about the impeller 150. The inlets 1811 may be unevenly distributed along the circumference of the impeller 150 in other cases.

In some embodiments, such as shown in FIG. 3B, the extraction ports 181 may be defined at an interface between the shroud 160 and the diffuser body 171. In other words, the shroud 160 and the diffuser body 171 may mate at a common edge, where they contact each other between circumferentially adjacent extraction ports 181. At such interface between the diffuser body 171 and the shroud 160, the common edge of the shroud 160 and the diffuser body 171 may form respective radially inward and radially outward wall of the extraction ports 181.

Referring back to the embodiment of FIGS. 3 and 3A, features of the reinjection port 182 will now be discussed. As mentioned above, the cavity 180 is in fluid communication with the main flow passage FP via at least one reinjection port 182 upstream of the extraction port 181.

The reinjection port 182 defines an outlet 182O in the gas path surface 162 of the shroud 160. The outlet 182O is located in the exducer portion EX. The outlet 182O is closer to the impeller outlet 154 than from the impeller inlet 153. The outlet 182O is located past the bend portion KN, in the exducer portion EX. The outlet 182O may be located within about one third (0.33±0.05) of the chord A of the impeller 150 from the exducer end 154. In some cases, the location of the outlet 182O may be in the last one third (0.33±0.05) of the chord A of the impeller 150. The outlet 182O may be located where the bend portion KN transitions to the exducer portion EX. Such location may be further than about one third (0.33±0.05) of the chord A from the exducer end 154, depending on the compressors 140 and/or profile of the impeller 150.

In the depicted embodiment, there is a single reinjection port 182 extending annularly about the central axis 11. The reinjection port 182 is in the form of a circumferential slot defined in the gas path surface 162 (see FIG. 3A). As shown, the outlet 182O in the shroud gas path surface 162 having a radial width w. A ratio between the width w and an axial width H of the impeller 150 at the impeller outlet 154 may be $0.03 \leq w/H \leq 0.2$ in some embodiments. In some embodiments, such ratio w/H may allow obtaining a maximum flow and a maximum flow velocity at the reinjection port 182. Other ratios may be contemplated in other embodiments.

In the depicted embodiment, the reinjection port 182 is angled radially outwardly from the cavity 180 to the outlet 182O. The reinjected flow may thus have a direction component that is tangential to the shroud gas path surface 162 and/or a radial direction component such as the flow in the main flow passage FP. Such orientation tangential orientation of the reinjected flow relative to shroud gas path surface 162 may minimize mixing loss and further improve the performance of the centrifugal compressor 140 and/or diffuser 170 downstream thereof.

A radial angle θ of a central line Y of the reinjection port 182 at the outlet 182O with respect to the central longitudinal axis 11 is in some cases $45° \leq \theta < 90°$ or $60° \leq \theta < 90°$. The radial angle θ may be different in other embodiments, such as smaller than 45°, though maximizing the tangential direction component of the reinjected flow may be desirable to minimize mixing loss at the reinjection point.

In the depicted embodiment, the reinjection port 182 is tapered in a direction extending from the cavity 180 toward the main flow passage FP (i.e. it forms a converging exit passage). As shown, the reinjection port 182 has an outlet 182O defined in the shroud gas path surface 162 that has a cross-section smaller than a remainder of the reinjection port 182. The reinjection port 182 is a converging (progressively or constantly) channel towards the main flow passage FP. Fluid flow reinjected into the main flow passage FP via the reinjection port 182 may thus be accelerated via the converging reinjection port 182. As the flow in the cavity 180 has a lower velocity, having the converging reinjection port 182 may reduce flow distortion at the reinjection point, with a reinjection flow at a velocity closer to the velocity of the flow in the main flow passage FP. In some cases, the converging reinjection port 182 has a cross-section differential of 2:1 from the cavity 180 to the outlet 182O, in some other cases, 3:1, in some other cases more than 3:1 or less than 2:1. Having a ratio of 3:1 or higher may provide more velocity hence more convergence, in some embodiments. In a particular embodiment, where the reinjection port 182 is in the form of a circumferential slot having a radial width w, the reinjection port 182 has a cross-sectional differential greater than 2:1 and a length taken between the cavity 180 and the outlet 182O along line Y≥3 times the radial width w (or between about 3 and 10 times the radial width w). A cross-sectional differential of 3:1 or higher (e.g. between 3:1 and 5:1).

The reinjection port 182 may have other suitable shapes in other embodiments. For instance, the reinjection port 182 may have a convergent-divergent shape, such that the reinjection port 182 may have a choked cross-section, i.e. a cross-sectional area that reduces before enlarging toward the outlet 182O. The reinjection port 182 may have a constant cross-section in other embodiments.

Figure 4:
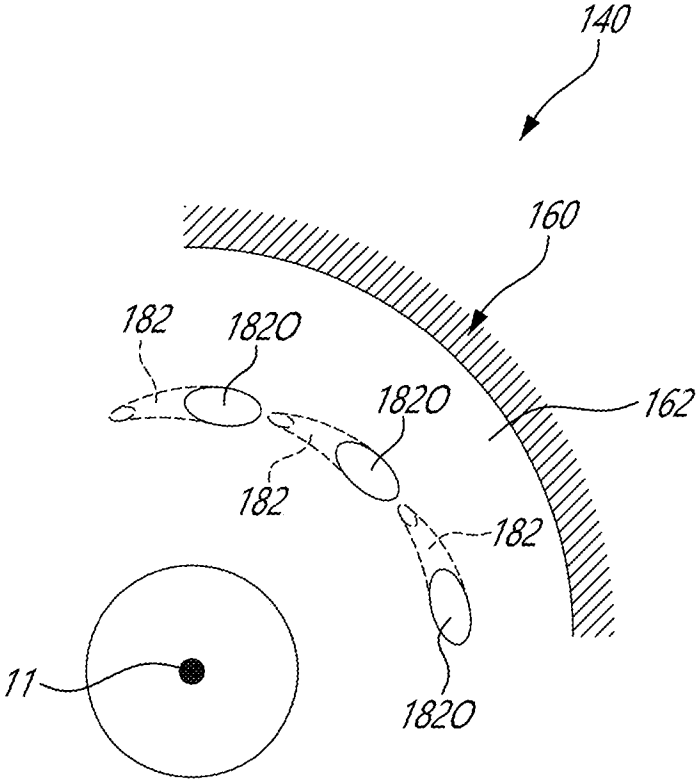
FIG. 4 is a schematic cross-sectional partial view of another exemplary shroud of the centrifugal compressor taken in plane normal to a central axis of the centrifugal compressor, according to an embodiment.

In other embodiments, there may be a plurality of reinjection ports 182, in the form of circumferentially spaced apart holes about the central axis 11. In such cases, the reinjection ports 182 may have many suitable cross-section shapes. In embodiments where the reinjection ports 182 have a round shape (e.g. circular shape), the round shape may be elongated, such as in an oval or elliptical shape. This is shown in the example of FIG. 4. In some other embodiments, the apertures 32 may have other shapes, such as a rectangular cross-sectional shape. In some embodiments, the reinjection ports 182 have a constant cross-section shape, though the cross-section shape may vary from the cavity 180 to the outlet 182O. Also, while all the reinjection ports 182 may have a uniform cross-section shape in an embodiment, one or more reinjection ports 182 may have different cross-section shapes than one or more other reinjection ports 182, in some embodiments.

In addition to or instead of being tapered and/or radially angled, the reinjection ports 182 may be circumferentially angled relative to a plane normal to the central longitudinal axis 11 (see FIG. 4). In other words, in some embodiments, the outlets 182O of the reinjection ports 182 may be circumferentially offset relative to a remainder of their respective reinjection ports 182. The reinjection ports 182 may be angled circumferentially in a direction of rotation of the impeller 150, from the cavity 180 towards the main flow passage FP, which may minimize mixing loss at the reinjection point in the main flow passage FP.

Figure 5:
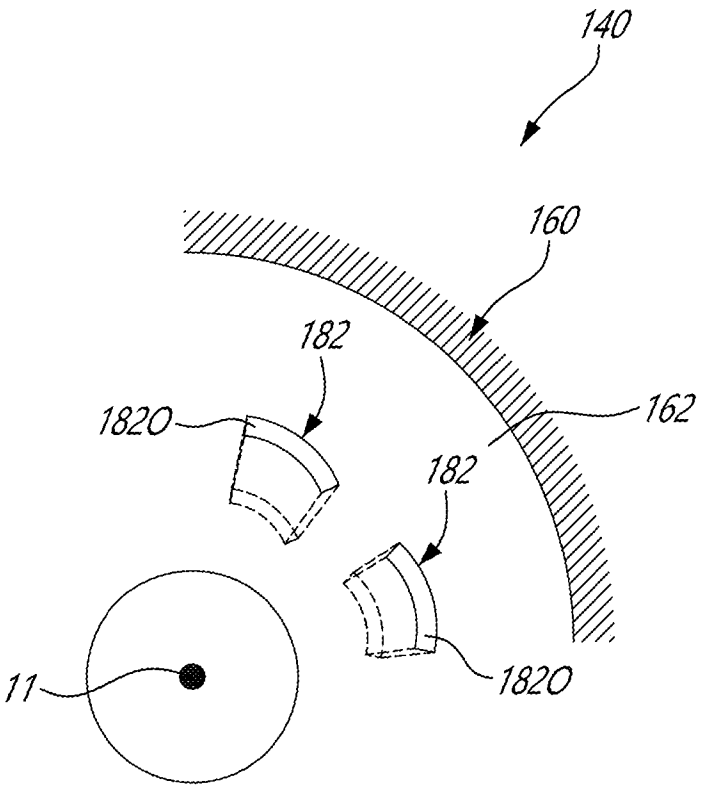

The reinjection ports 182 may have various suitable cross-section, such as a round or oval cross-section, whether or not constant over the whole length of the reinjection port 182. As other possibilities, with or without the tapering, the reinjection ports 182 may also take the form of a series of elongated slots. For instance, the elongated slots may have an arcuate cross-section shape, though other cross-section shapes may be contemplated. The arcuate cross-section shaped slots may have their radius oriented toward the central longitudinal axis 11, such as shown in FIG. 5. The arcuate cross-section shape may also have their radius oriented differently, for instance away from the central longitudinal axis 11, in other embodiments. The elongated slots may extend through the main flow passage wall defined by the shroud 160 (i.e. and surface 162) with a radially outward directional component from the cavity 180 towards the main flow passage FP (see dashed line showing in-plane extension of the slots), such as to define an angle θ as discussed above with reference to FIG. 3, to be as much tangentially as possible to the main flow passage FP.

Referring jointly to FIGS. 2 and 3, during operation of the centrifugal compressor 140, the pressure inside the centrifugal compressor 140 increases from the inducer end 153 to the exducer end 154 of the impeller 150. There is thus a pressure gradient between the inducer end 153 and the exducer end 154. The fluid flow is pressure driven, such that the flow will move from a high pressure region to a low pressure region. The extraction port 181 is located at a higher pressure region than the reinjection port 182. The pressure differential between the extraction port 181 and the reinjection port 182, which are interconnected between the cavity 180 and the main flow passage FP, induces a recirculation loop in the recirculation direction illustrated by the arrows X and Y in FIG. 3. Recirculation may be maximized by increasing the pressure differential between the extraction port 181 and the reinjection port 182. This may be obtained by having the extraction port 181 and the reinjection port 182 at a greater radial distance (taken relative to axis 11) from each other such as to have a greater pressure differential between them.

A method of re-energizing a flow in an exducer portion of a centrifugal compressor as discussed above is also disclosed. The method includes circulating part of the flow through the cavity 180 having at least one extraction port 181 fluidly connected to the main flow passage FP of the compressor 140 downstream of at least one reinjection port 182 fluidly connected to the main flow passage FP. In some cases, circulating part of the flow includes extracting said part of the flow downstream of the exducer portion EX. In some cases, circulating includes reinjecting at least a fraction of said part of the flow back to the main flow passage FP at a location radially inward relative to the extraction port 182, in the exducer portion EX. In some cases, injecting at least said fraction of said part of the flow includes accelerating said fraction of said part of the flow through the injection port 181.

The above description is meant to be exemplary only, and one skilled in the art will recognize that changes may be made to the embodiments described without departing from the scope of the invention disclosed. Even though the present description and accompanying drawings specifically refer to aircraft engines and centrifugal compressor therefor, aspects of the present disclosure may be applicable to automobile applications or other applications where impeller type pumps and/or compressors may be found and subject to flow blockage for the reasons described above.

Still other modifications which fall within the scope of the present invention will be apparent to those skilled in the art, in light of a review of this disclosure, and such modifications are intended to fall within the appended claims.

The invention claimed is:

1. A centrifugal compressor for an aircraft engine, comprising:

an impeller mounted for rotation about an axis, the impeller having impeller blades extending from an inducer end to an exducer end;

a shroud extending over the impeller blades;

a main flow passage defined between the shroud and the impeller;

a cavity fluidly communicating with the main flow passage via at least one extraction port and at least one reinjection port, the at least one reinjection port fluidly connected to the main flow passage upstream of the extraction port relative to a flow direction through the main flow passage, the at least one reinjection port disposed upstream of the exducer end of the impeller blade, in an exducer portion of the shroud, wherein the at least one reinjection port defines a reinjection outlet in a gas path surface of the shroud, the gas path surface defining a bend portion extending between an inducer portion and the exducer portion, the reinjection outlet located within about one third of the chord of the impeller from the exducer end.

2. The centrifugal compressor as defined in claim 1, wherein the impeller has a shroud side and an opposite hub side, the cavity located on the shroud side of the impeller.

3. The centrifugal compressor as defined in claim 1, wherein the cavity is annular, the cavity extending circumferentially about the axis.

4. The centrifugal compressor as defined in claim 1, wherein at least part of the cavity is radially aligned with the bend portion.

5. The centrifugal compressor as defined in claim 1, wherein at least part of the cavity extends radially along the exducer portion.

6. The centrifugal compressor as defined in claim 1, wherein the at least one reinjection port has a convergent shape between the cavity and the main flow passage.

7. The centrifugal compressor as defined in claim 1, wherein the at least one reinjection port has a central line extending from the cavity to a reinjection outlet defined in the gas path surface of the shroud, the central line radially angled such that a projection of the central line at the reinjection outlet extends radially away at an angle $\theta$ of $45° \leq \delta < 90°$ relative to the axis, in the flow direction.

8. The centrifugal compressor as defined in claim 1, wherein the at least one reinjection port is an annular slot defined through the shroud about the axis.

9. The centrifugal compressor as defined in claim 8, wherein the annular slot has an outlet defined at the gas path surface of the shroud, the outlet having a radial dimension w and the impeller having an axial width H at the exducer end of the impeller, a ratio w/H is $0.03 \leq w/H \leq 0.2$.

10. The centrifugal compressor as defined in claim 1, wherein the centrifugal compressor includes a plurality of reinjection ports defining a series of circumferentially spaced apart holes extending through the gas path surface of the shroud and angled circumferentially in a direction of rotation of the impeller from the cavity towards the main flow passage.

11. The centrifugal compressor as defined in claim 1, wherein the centrifugal compressor includes a plurality of reinjection ports defining a series of circumferentially spaced apart slots extending through the gas path surface of the shroud between the cavity and the main flow passage, the slots having a radially outward directional component from the cavity towards the main flow passage.

12. The centrifugal compressor as defined in claim 1, wherein the at least one extraction port is located upstream of the exducer end of the impeller, a projection of a center line of the at least one extraction port intersecting with the impeller.

13. A compressor section of an aircraft engine, comprising:

a centrifugal compressor including:

an impeller with impeller blades extending from an inducer end to an exducer end, a shroud extending about the impeller, the impeller mounted for rotation about an axis within the shroud, a main flow passage extending between the impeller and the shroud to an impeller exit defined downstream of the impeller, a cavity disposed adjacent the impeller exit, the cavity fluidly communicating with the main flow passage via at least one extraction port and at least one reinjection port, the at least one reinjection port fluidly connected to the main flow passage closer from the central longitudinal axis than the extraction port, in an exducer portion of the shroud, wherein the at least one reinjection port has a central line extending from the cavity to a reinjection outlet defined in a gas path surface of the shroud, the central line radially angled such that a projection of the central line at the reinjection outlet extends radially away at an angle $\theta$ of $45° \leq \theta < 90°$ relative to the axis, in the flow direction; and a diffuser body mounted about the impeller exit so as to receive a flow therefrom.

14. The compressor section as defined in claim 13, wherein the at least one reinjection port of the centrifugal compressor has a convergent shape from the cavity to the main flow passage.

15. The compressor section as defined in claim 13, wherein the impeller of the centrifugal compressor has a shroud side and an opposite hub side, the cavity located on the shroud side of the impeller.

16. The compressor section as defined in claim 13, wherein the extraction port is defined by a gap between the shroud and the diffuser.

17. The compressor section as defined in claim 16, wherein the gap is downstream of the exducer end of the impeller.

18. The compressor section as defined in claim 16, wherein the gap is annular and extends circumferentially about the axis.

19. A centrifugal compressor for an aircraft engine, comprising:

an impeller mounted for rotation about an axis, the impeller having impeller blades extending from an inducer end to an exducer end;

a shroud extending over the impeller blades;

a main flow passage defined between the shroud and the impeller;

a cavity fluidly communicating with the main flow passage via at least one extraction port and at least one reinjection port, the at least one reinjection port fluidly connected to the main flow passage upstream of the extraction port relative to a flow direction through the main flow passage, the at least one reinjection port disposed upstream of the exducer end of the impeller blade, in an exducer portion of the shroud, wherein the at least one reinjection port includes an annular slot having an outlet defined at a gas path surface of the shroud, the outlet having a radial dimension w and the impeller having an axial width H at the exducer end of the impeller, a ratio w/H is $0.03 \leq w/H \leq 0.2$.

* * * * *